US006550099B2

(12) United States Patent
Wörwag

(10) Patent No.: US 6,550,099 B2
(45) Date of Patent: Apr. 22, 2003

(54) VACUUM CLEANING TOOL WITH EXCHANGEABLE VACUUM SHOES

(75) Inventor: Peter Wörwag, Romanshorn (CH)

(73) Assignee: Düpro AG, Romanshorn (CH)

( * ) Notice: Subject to any disclaimer, the term of this patent is extended or adjusted under 35 U.S.C. 154(b) by 0 days.

(21) Appl. No.: 09/761,262

(22) Filed: Jan. 16, 2001

(65) Prior Publication Data

US 2001/0008036 A1 Jul. 19, 2001

(30) Foreign Application Priority Data

Jan. 15, 2000 (DE) ..... 100 01 467

(51) Int. Cl.[7] ..... A47L 9/04

(52) U.S. Cl. ..... 15/387; 15/338; 15/389; 15/392

(58) Field of Search ..... 15/328, 338, 378, 15/387, 389, 392

(56) References Cited

U.S. PATENT DOCUMENTS

| | | | | | |
|---|---|---|---|---|---|
| 1,713,184 | A | * | 5/1929 | Lang | 15/328 |
| 1,856,875 | A | * | 5/1932 | Leonard | 15/328 |
| 2,089,911 | A | * | 8/1937 | Replogle | 15/328 |
| 2,668,979 | A | * | 2/1954 | MacFarland | 15/378 |
| 2,730,750 | A | * | 1/1956 | Briere | 15/389 |
| 2,785,431 | A | * | 3/1957 | Pardee | 15/378 |
| 3,790,987 | A | | 2/1974 | MacFarland | 15/392 |
| 4,151,628 | A | * | 5/1979 | Maurer et al. | 15/415.1 |
| 4,305,176 | A | * | 12/1981 | Lessig et al. | 15/387 |
| 4,306,330 | A | * | 12/1981 | Jinkins | 15/387 |
| 4,700,428 | A | * | 10/1987 | Hetherington | 15/338 |
| 5,455,982 | A | * | 10/1995 | Armstrong et al. | 15/328 |
| 5,799,364 | A | * | 9/1998 | Foisy et al. | 15/338 |
| 6,226,832 | B1 | * | 5/2001 | McCormick | 15/389 |

FOREIGN PATENT DOCUMENTS

| | | | |
|---|---|---|---|
| DE | 1985073 | * | 5/1968 |
| DE | 198 05 901 | | 8/1999 |
| GB | 283477 | | 4/1928 |
| GB | 1 416 360 | | 12/1975 |

* cited by examiner

*Primary Examiner*—Theresa T. Snider
(74) *Attorney, Agent, or Firm*—Gudrun E. Huckett

(57) ABSTRACT

A vacuum cleaning tool for a vacuum cleaning device has a housing having a vacuum connector connected to the vacuum cleaning device. The housing has an underside and an elongate intake opening arranged in the underside. A brush roll is arranged in the housing parallel to the elongate intake opening. A drive is arranged in the housing and drivingly coupled to the brush roll. An exchangeable vacuum shoe is detachably connected to the housing and has two wall portions extending at least approximately parallel to the brush roll. The brush roll is arranged between the two wall portions.

24 Claims, 11 Drawing Sheets

VACUUM CLEANING TOOL WITH EXCHANGEABLE VACUUM SHOES

BACKGROUND OF THE INVENTION

1. Field of the Invention

The invention relates to a vacuum cleaning tool for a vacuum cleaning device, in particular, for cleaning floors. The vacuum cleaning tool comprises a housing having a vacuum connector for the vacuum cleaning device and an elongate intake opening provided at the underside of the housing wherein a brush roll is provided which extends parallel to the intake opening and is coupled with a drive.

2. Description of the Related Art

Vacuum cleaning tools are used primarily for cleaning floors. They are provided with rotating brush rolls for removing dirt from the floor. The brush rolls are arranged in the area of the intake opening. The bristle arrangement of such brush rolls is employed, depending on the type of floor, i.e., smooth floors or carpeting, with an action of different strength, wherein the bristles for a soft floor penetrate deeper than for a hard, smooth floor. As a function of the number of bristles as well as their elasticity as well as the rotational speed of the corresponding roll, a polishing effect can also be achieved which, however, is very limited as a result of the minimum weight of such universal vacuum cleaning tools. For this reason, special polishing devices have been proposed which are required in addition to a vacuum cleaning tool and have an electrical drive with considerable weight acting on a disc with a polishing bristle arrangement rotating about a vertical axis.

SUMMARY OF THE INVENTION

It is an object of the present invention to provide a vacuum cleaning tool of the aforementioned kind which can be universally used for different types of flooring and which can be manipulated easily.

In accordance with the present invention, this is achieved in that a vacuum shoe is exchangeably connected to the housing and comprises at least two wall portions extending substantially parallel to the brush roll between which the brush roll is received.

By providing a vacuum shoe that is exchangeable, the operator can adapt in a simple way the vacuum cleaning tool to the respective requirements of the floor to be treated so that the respective type of flooring can be cleaned and cared for in the proper way. Accordingly, for the different types of requirements only a single device is needed which can be easily manipulated.

According to a further embodiment of the invention, the vacuum shoe is provided at the ends of the wall portions with sidewalls which provide the spacing of the wall portions relative to one another. The vacuum shoe forms thus a frame which is exchangeable in its entirety. Preferably, the sidewalls and wall portions of the vacuum shoe form a monolithic body and are comprised, in particular, of a plastic material. In order to facilitate the exchange of the vacuum shoe, a clamping connection, clip connection or snap connection is provided for attachment of the vacuum shoe to the housing. In this context, it is expedient for the vacuum shoe to have openings to be engaged by projections on the housing. These openings are expediently arranged in the sidewalls of the vacuum shoe, and the projections are in the form of pins projecting laterally from the housing. In order for the pins to be able to provide a double function, i.e., on the one hand, attachment of the vacuum shoe, and, on the other hand, providing a bearing action for the brush roll, the pins are arranged coaxially to the rotational axis of the brush roll. It may be expedient to provide the openings in the form of bores in elastically deformable sidewalls of the vacuum shoe so that the introduction of the pins in the bores as well as the detachment therefrom can be realized by temporary deformation of the sidewalls. As an alternative, the openings for receiving the pins can be of a substantially circular shape and can have connected thereto a radial slot extending away from the opening wherein the end of the slot adjacent or connected to the opening has a width that is smaller than the diameter of the pin.

In order for the vacuum cleaning tool not to scrape on the floor to be treated and to facilitate movement of the vacuum cleaning tool across the floor, rollers are provided at the underside of the vacuum shoe with which the vacuum cleaning tool is supported on the floor. For the treatment of carpets and soft floors, the vacuum shoe is expediently of a flat configuration so that the bristles of the brush roll project through the air intake opening.

For treating hard floors, a polishing roll is provided in a vacuum shoe of a different design. It extends parallel to the intake opening and substantially fills out the intake opening. The polishing roll with its mantle surface projects past the plane of the underside of the vacuum shoe. The drive of the polishing roll is realized preferably such that the bristles of the rotating brush roll of the vacuum cleaning tool engage the surface of the polishing roll and thus cause rotation of the polishing roll. As an alternative to this, the polishing roll can have an intermediate gear for driving the polishing roll which preferably cooperates with a gear wheel provided at an end face of the polishing roll. For enabling a simple removal of the polishing roll, for example, for the purpose of cleaning the polishing roll, the polishing roll is received in bearings that can be locked or secured within the sidewalls of the vacuum shoe.

As a drive for the brush roll and the polishing roll an air turbine is preferably provided which is arranged in a turbine chamber. It is also possible to provide an electric motor as a drive for the rolls instead of the air turbine. The shaft of the air turbine, or of the electric motor, is expediently provided with a toothed disc, and the shaft is coupled by means of a toothed belt with the brush roll.

The polishing roll is comprised preferably of a core with axle pins at the end faces and with a cover arranged on the core and formed preferably of a textile material. In this connection, it is possible to design the cover such that it forms a uniform covering over the entire axial length and is connected to the core only in the vicinity of the axial ends of the core. The textile cover is loose (unattached) relative to the roll-shaped core across the axial length of the core between the connecting locations of the cover and the core so that as a result of the circumferential speed and the resulting centrifugal forces the cover is forced into the uneven portions and cracks of the hard flooring.

The cover can also be comprised of several portions sequentially arranged in the axial direction wherein the textile covering in the respective portions has different heights and/or different degrees of hardness. For example, the portions with a higher (taller), soft covering can have a length of approximately 3 mm and the portions with a lower (shorter), hard covering can have a length of approximately 10 mm. Since the polishing roll as a result of its weight or the weight of the vacuum cleaning tool rests with the portions of the harder textile covering on the hard flooring, the fluffy textile covering of the soft portions is forced outwardly upon rotation of the polishing roll by the resulting centrifugal forces so that this covering reaches the uneven portions of the hard floor and thus produces a cleaning effect thereat. The cover of the polishing roll can be attached on the core by adhesives or by welding.

According to a further embodiment of the invention, the polishing roll is supported in a floating fashion in the sidewalls of the vacuum shoe by means of elastic components. This provides an automatic adaptation of the drive of the polishing roll.

DESCRIPTION OF THE PREFERRED EMBODIMENTS

Figure 1:
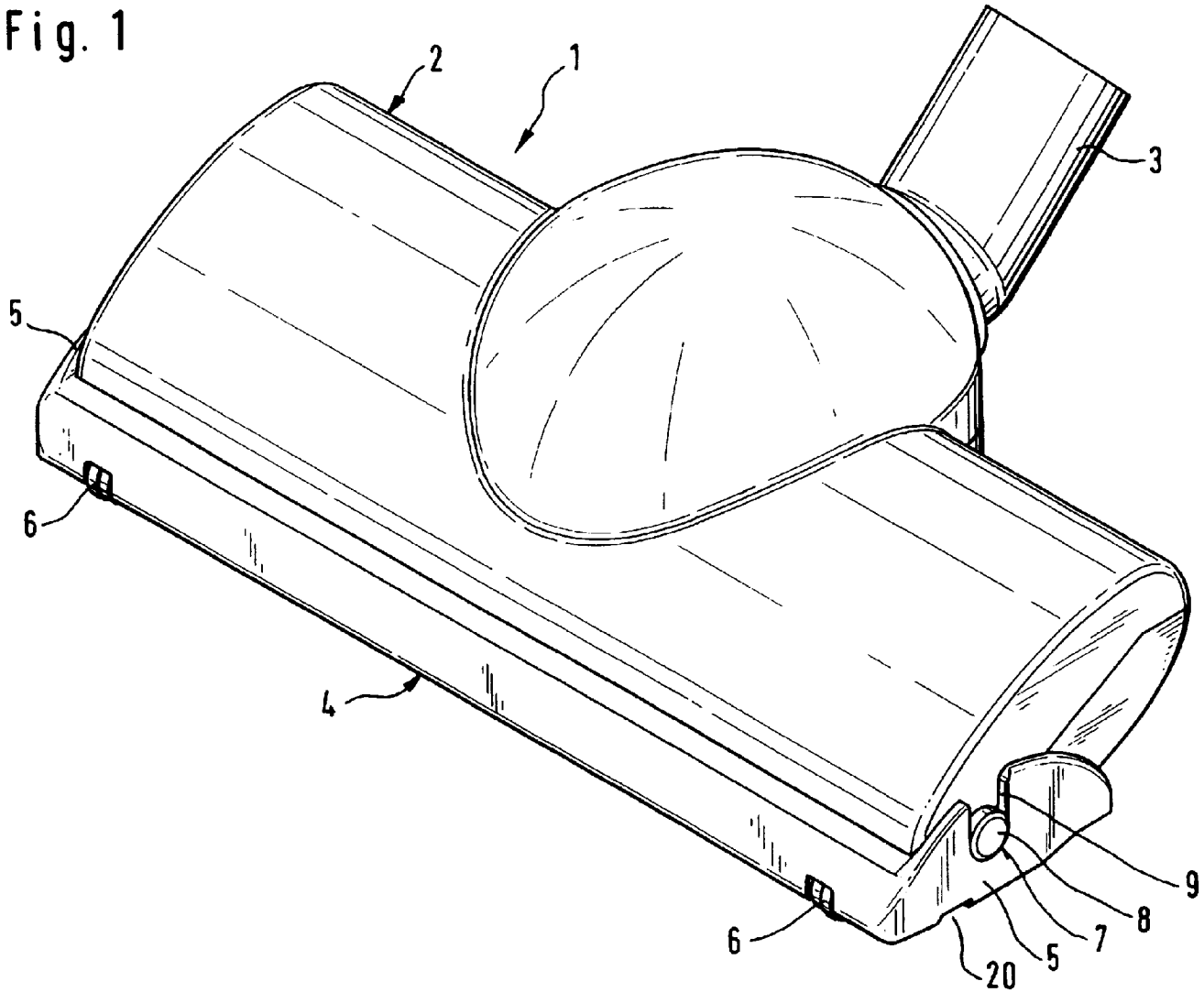
FIG. 1 is a perspective view of the exterior of a vacuum cleaning tool of a first embodiment of the vacuum shoe.

FIG. 1 shows a vacuum cleaning tool 1 with a housing 2 on which a vacuum connector 3 for a vacuum cleaning device, not illustrated in the drawing, is arranged. In the front area of the housing 2, a vacuum shoe 4 is arranged at its underside wherein in FIG. 1 a sidewall 5 of the vacuum shoe can be seen. The vacuum shoe 4 is provided at the underside with rollers 6 by which the vacuum cleaning tool 1 is supported on the floor to be treated. The sidewall 5 is provided with an opening 7 which is substantially circular in shape so that it is suitable for receiving a pin 8 provided laterally on the housing 2. Since the vacuum shoe 4 should be detachable and removable in a simple way, a slot 9 extending radially relative to the opening 7 is provided wherein the end of the radial slot 9 facing the opening 7 has a width that is smaller than the diameter of the pin 8. Accordingly, an undercut results which secures the pin 8 in the opening 7; an elastic widening is achieved only by applying a corresponding pressure onto the pin 8 in the direction of the slot 9, and, in this way, the pin 8 can be moved out of the opening 7. The introduction of the pin 8 into the opening 7 is also simple because the outer end of the radial slot 9 has a width matching that of the pin 8 so that the pin 8 can be introduced without problems and the radial slot 9 gradually tapers toward the opening 7 so that the pin 8 can snap into the opening 7.

Figure 2:
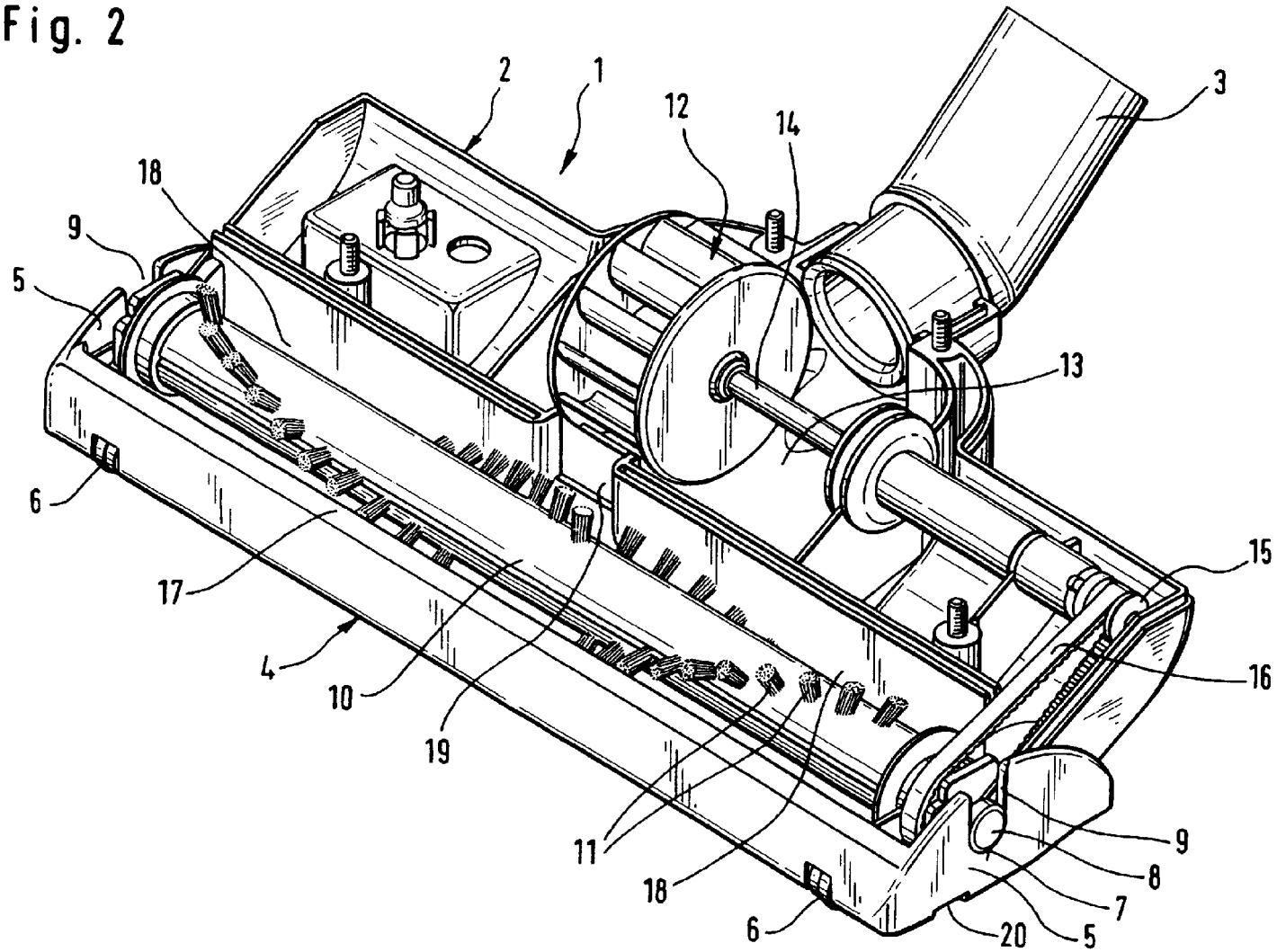
FIG. 2 is a perspective illustration of the inner configuration of the vacuum cleaning tool according to FIG. 1.

In FIG. 2, a perspective illustration of the inner configuration of a vacuum cleaning tool 1 is illustrated. FIG. 2 shows that in the front area of the housing 2 a brush roll 10 is arranged which extends with its longitudinal axis along the air intake opening provided at the underside of the vacuum shoe 4. The brush roll 10 is provided with a bristle arrangement which is formed of a plurality of bristles 11. The rows of these bristles 11 are arranged in a spiral about the brush roll 10. For driving the brush roll 10, an air turbine 12 is provided which is arranged in a turbine chamber 13. The turbine shaft 14 of the air turbine 12 has an end that is provided with a toothed belt wheel 15 about which a toothed belt 16 is guided for driving the brush roll 10.

The sidewalls 5 of the vacuum shoe 4 are provided with an opening 7, respectively, and a radial slot 9 so that each opening 7 is engaged by a pin 8 arranged at the sides of the housing 2, respectively. These pins 8 are arranged coaxially to the rotational axis of the brush roll 10 so that the pins 8 which are hollow act as bearings for the axes of the brush roll 10. The vacuum shoe 4 comprises two parallel extending wall portions 17, 18 between which the brush roll 10 is arranged. On the underside of the vacuum shoe 4 the intake opening 20 is provided via which the air is taken in. The intake air enters the turbine chamber 13 via the inflow opening 19 provided between the wall portions 18 and thus drives the air turbine 12. From the air turbine chamber 13 the air is then guided through the vacuum connector 3 to the vacuum device, not illustrated.

Figure 3:
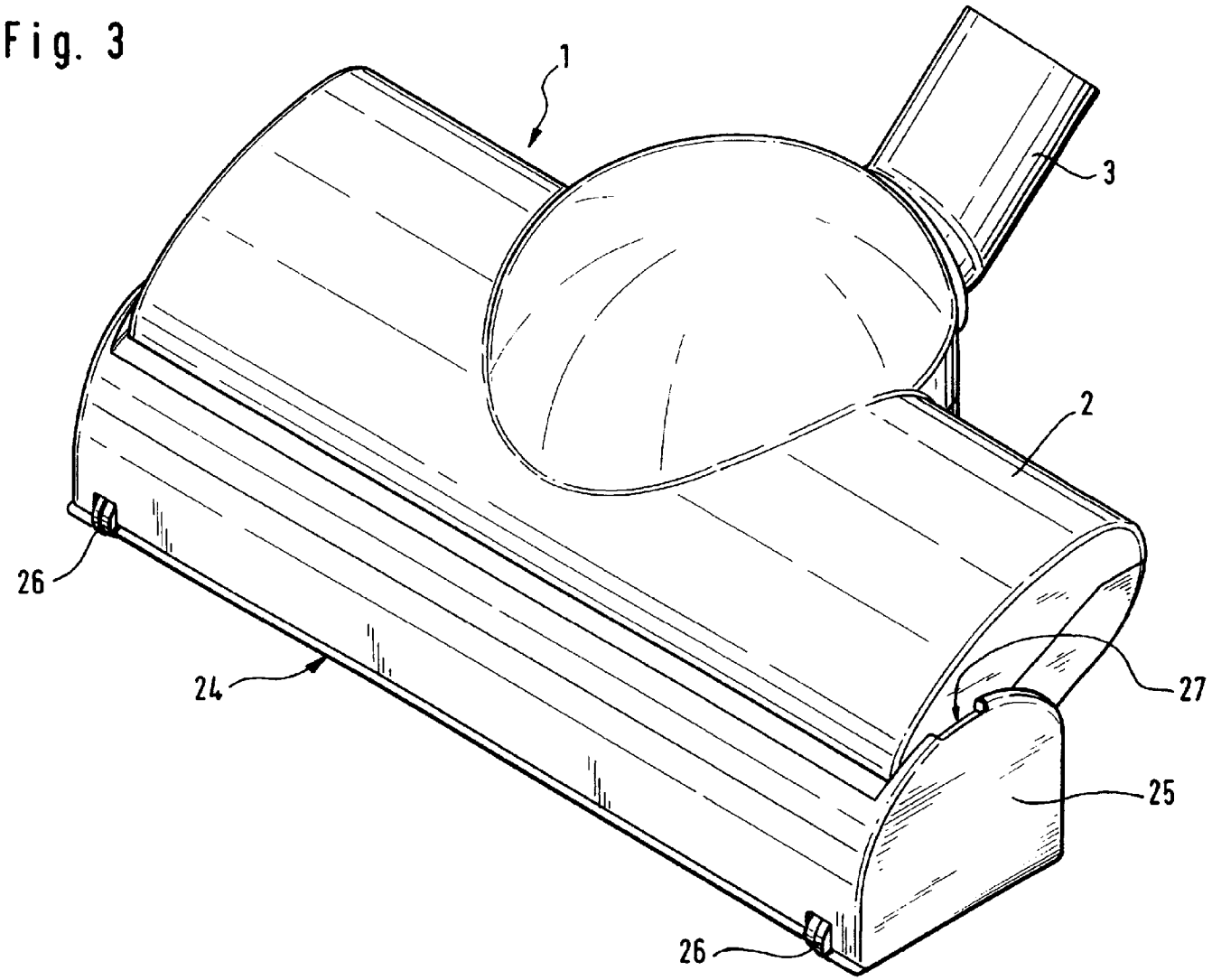
FIG. 3 is a representation of the vacuum cleaning tool with a vacuum shoe of a different embodiment.

FIG. 3 shows in a perspective illustration the vacuum cleaning tool 1 having a vacuum shoe 24 fastened on the housing 2. The vacuum shoe 24 has a greater height in comparison to the afore described vacuum shoe 4 as can be seen when comparing the FIGS. 1 and 3. The vacuum shoe 24 is provided with rollers 26 and has sidewalls 25 in which openings 27 are provided for fastening the vacuum shoe 24 on the already mentioned pins 8.

Figure 4:
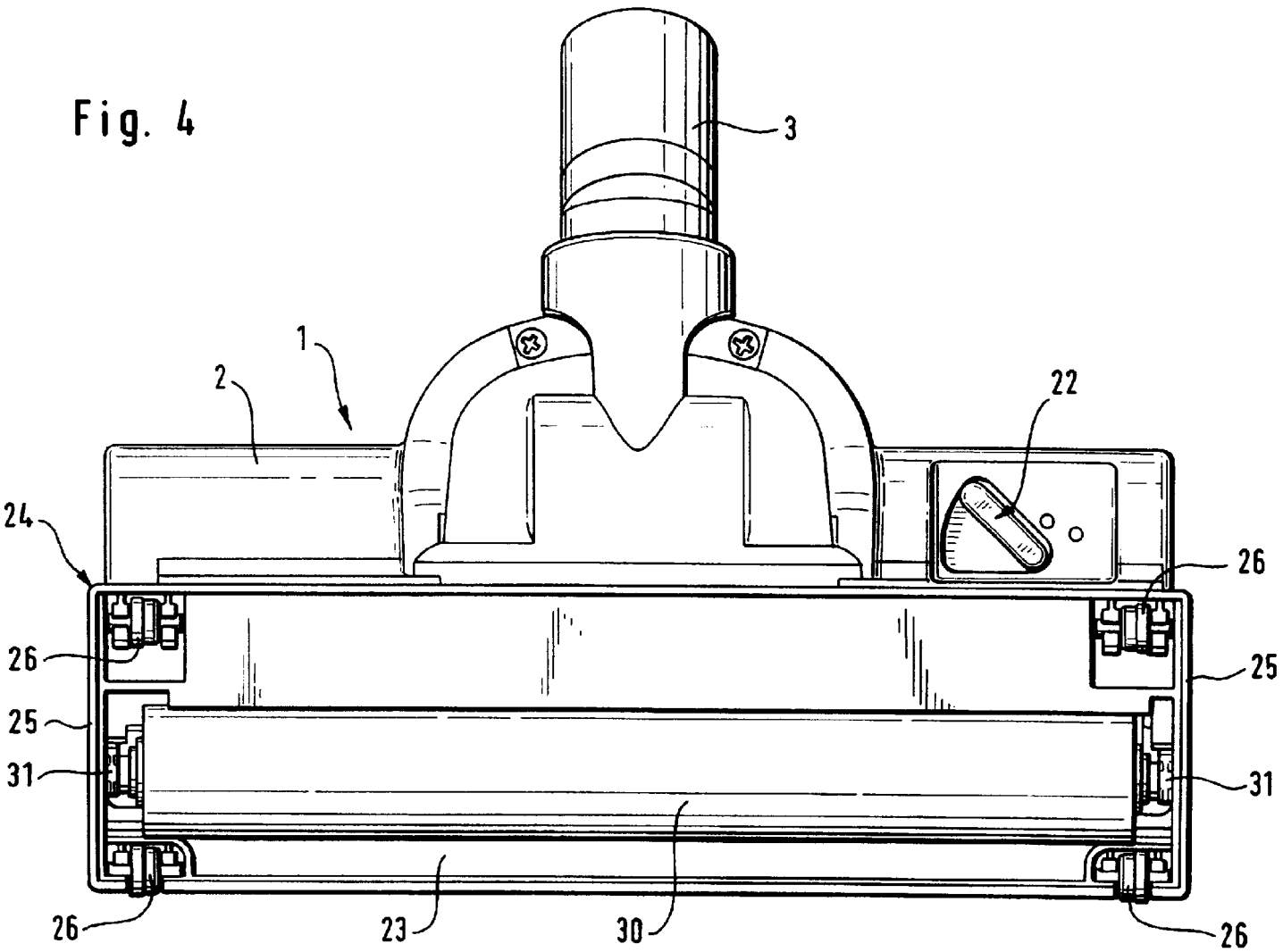
FIG. 4 is a view of the vacuum cleaning tool from below.

FIG. 4 shows a view of the underside of the vacuum cleaning tool 1 with a vacuum shoe 24 fastened to the housing 2. The vacuum shoe has four rollers 26. The vacuum shoe 24 has an intake opening 23 and a polishing roll 30 extending parallel thereto and supported between the sidewalls 25 of the vacuum shoe 24. The polishing roll 30 is provided with bearings 31 at its end faces for rotatably supporting it in the vacuum shoe 24. Moreover, at the underside of the housing 2 an actuator element 22 is provided that covers in the position illustrated in FIG. 4 a bypass opening which can be opened by pivoting the actuator element 22.

Figure 5:
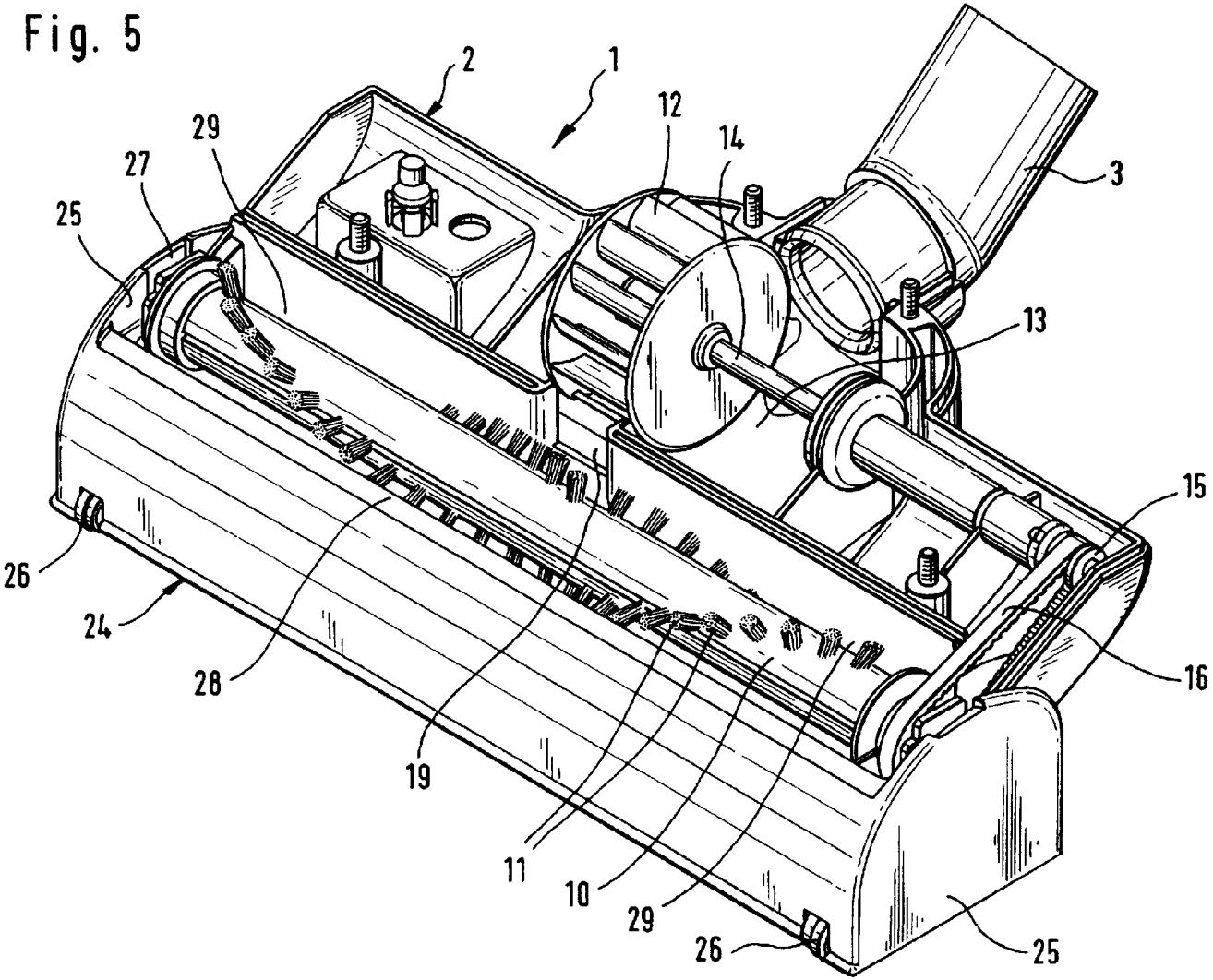
FIG. 5 is a representation of the vacuum cleaning tool according to FIG. 2 with a vacuum shoe of a different embodiment.

FIG. 5 shows an illustration of the vacuum cleaning tool 1 according to FIG. 2 but provided with the vacuum shoe 24 of FIG. 3. As illustrated in FIG. 5, the brush roll 10 with its drive via the air turbine 12 and the toothed belt 16 is completely identical to the embodiment of FIG. 2 so that with respect to this embodiment reference is being had to the description of FIG. 2. The reference numerals in FIG. 5 are therefore identical for parts identical with those of FIG. 2.

Figure 6:
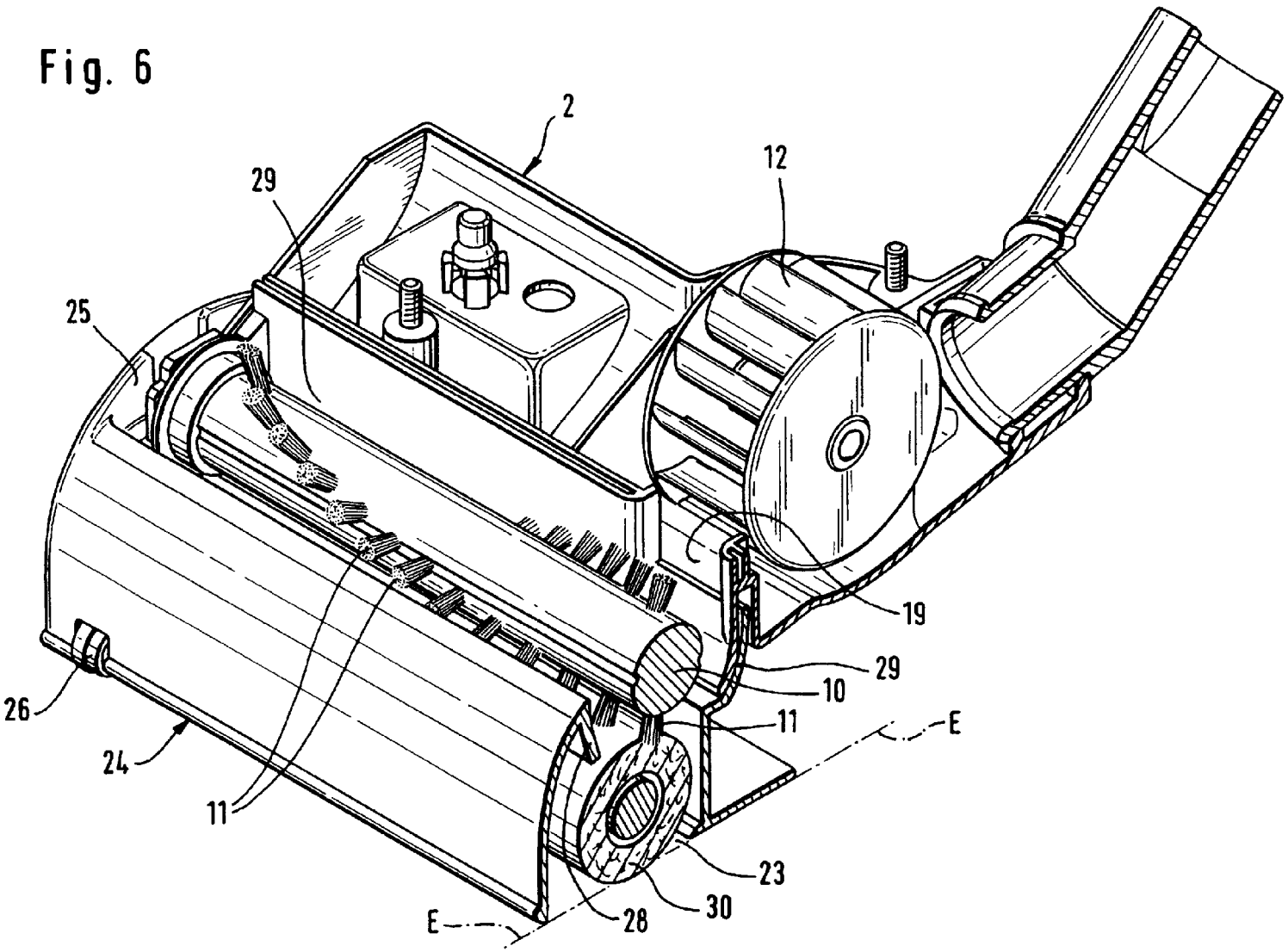
FIG. 6 is a cross-sectional view of the illustration according to FIG. 5.

FIG. 6 shows a cross-section of the illustration according to FIG. 5, showing that the brush roll 10 is arranged between parallel extending wall portions 28 and 29. These parallel wall portions 28, 29 extend in the upper area of the vacuum shoe 24, while the polishing roll 30 is arranged in the lower area. The polishing roll 30 has an outer circumference which is of such a size that the polishing roll projects by a certain amount past the plane E of the underside of the vacuum shoe 24 in order to treat the flooring. As is illustrated in FIG. 6, the bristle length of the bristles 11 of the brush roll 10 is large enough for engaging the surface of the polishing roll 30 so that, when driving the brush roll 10 by the air turbine 12, the polishing roll 30 is also driven. In this connection, the rotational direction of the polishing roll 30 is opposite to the rotational direction of the brush roll 10 which is indeed advantageous. Since the brush roll rotates toward the intake opening and the polishing roll has the opposite rotational direction, the kickback effect observed on hard floorings is avoided. In order to counteract this effect, it is known to carry out additional measures, for example, to provide a rubber lip; this is, however, an additional expenditure. The vacuuming power of conventional vacuum cleaning devices is large enough in order to prevent flinging of the vacuumed material. The force transmission from the brush roll 10 onto the polishing roll 30 is realized by the principle of a slipping clutch. Accordingly, a natural slip results as a function of the torques applied to the brush roll 10 and the polishing roll 30. As a result of the continuous action of the bristles 10 onto the surface of the polishing roll 30 a cleaning effect for the polishing roll results and the removed dirt particles are entrained by the vacuum flow and carried away.

Figure 7:
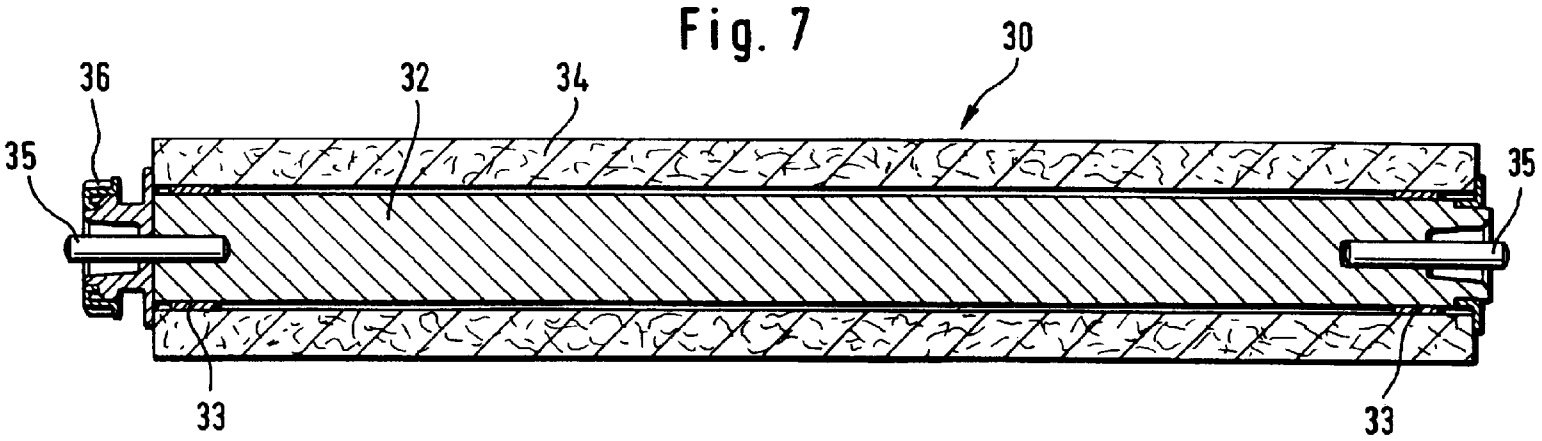
FIG. 7 is a longitudinal section of a first embodiment of the polishing roll.

FIG. 7 shows a longitudinal section of a first embodiment of the polishing roll 30 which is comprised of a central core 32 and a cover 34 enveloping it as a mantle. The cover 34 is preferably a textile covering that, depending on the requirements, is softer or harder, i.e., more wear resistant or more abrasive. The cover 34 is connected in the vicinity of its axial ends with the core 32, in particular, by means of adhesive connections 33 so that the cover 34 is loose (unattached) relative to the core 32 in the area between the adhesive connections 33. Bearing pins 35 are inserted into the end faces of the core 32. The bearing pins 35 are received in corresponding bearings provided in the sidewalls of the vacuum shoe. When rotating the polishing roll 30 with a certain rotational speed, a centrifugal force acts on the textile material of the cover 34 by which the cover is radially expanded so that the polishing roll can thus treat uneven locations and cracks in the hard floor.

Even though FIG. 6 shows that the drive of the polishing roll 30 can be realized by the bristles of the brush roll, FIG. 7 shows that it is also possible to drive the polishing roll 30 by the gear wheel 36 arranged at one end face, i.e., the drive of the polishing roll 30 is realized by means of an intermediate gear via the air turbine.

Figure 9:
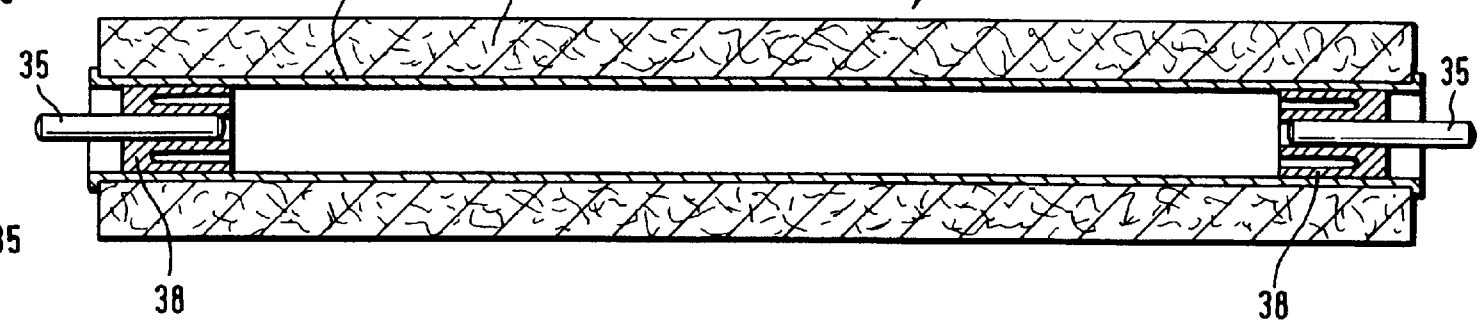
FIG. 9 is a longitudinal section of the polishing roll according to FIG. 8.
Figure 8:
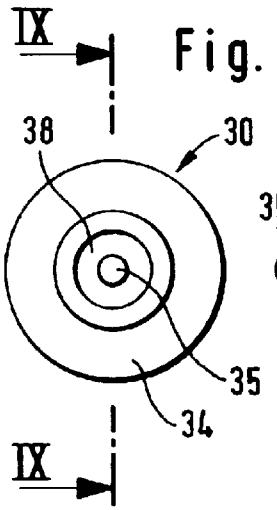
FIG. 8 is an end face view of a second embodiment of the polishing roll.

FIG. 8 shows an end view of the second embodiment of the polishing roll in which a gear wheel at the end face is not required. As can be seen in FIG. 9, in this embodiment the polishing roll 30 has a core in the form of a tube 37. Plugs 38 are inserted into its ends which receive the bearing pins 35. The cover 34 in this embodiment is welded onto the entire surface of the tube 37 forming the core.

Figure 10:
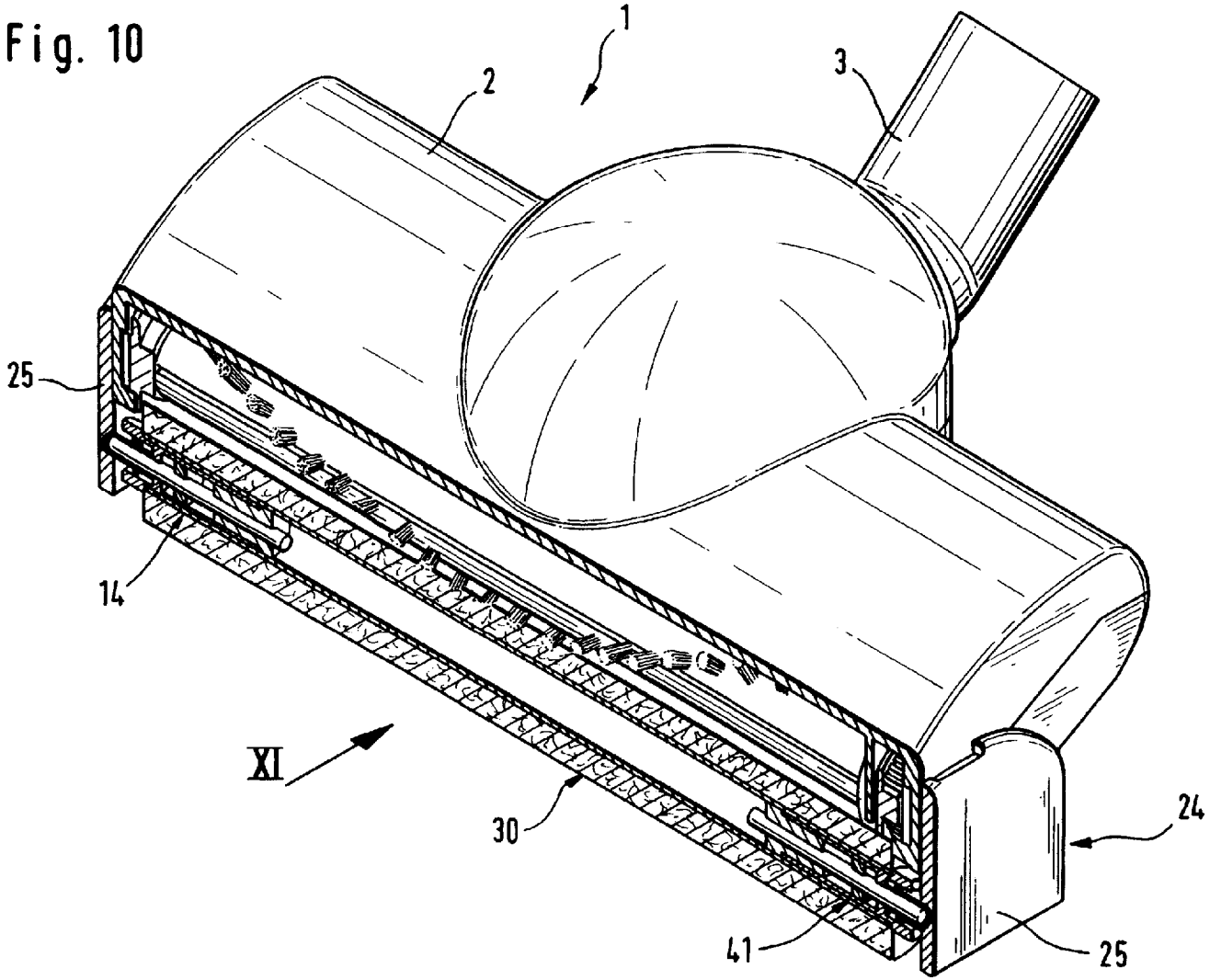
FIG. 10 is a perspective illustration of the vacuum cleaning tool showing also a vertical section along the axis of the polishing roll.

FIG. 10 shows a perspective illustration of the vacuum cleaning tool according to FIG. 3 with a vertical section along the rotational axis of the polishing roll 30. The polishing roll 30 is provided with bearings 41 whose bearing pins engage corresponding recesses or openings in the sidewalls 25 of the vacuum shoe 4. The drive of the polishing roll 30 is realized in this embodiment by means of the rotating brush roll 10.

Figure 11:
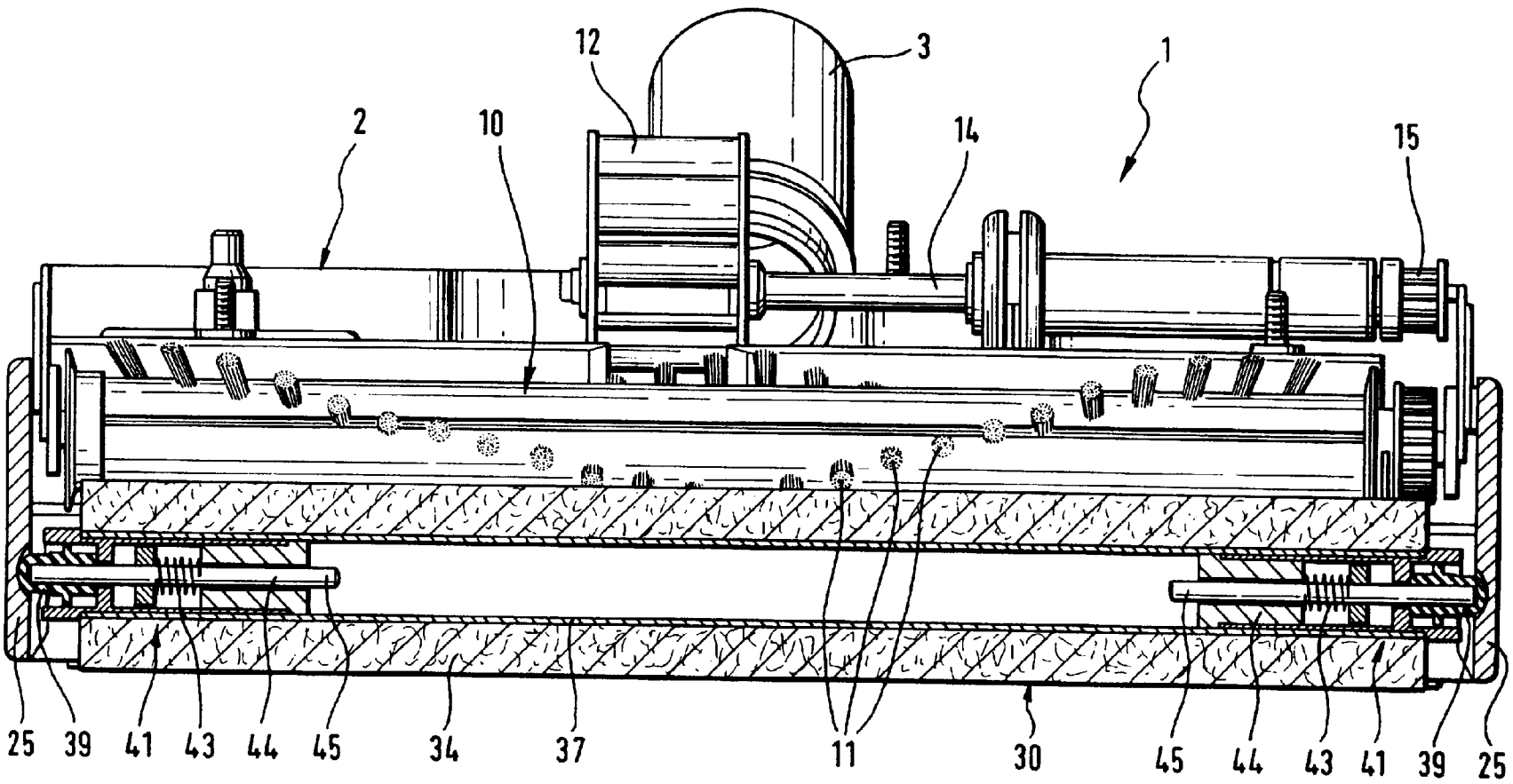
FIG. 11 is a view in the direction of arrow XI in FIG. 10.

FIG. 11 shows a view in the direction of arrow XI of FIG. 10, however, with the lid of the housing being removed, so that the air turbine 12 with the turbine shaft 14 and the toothed belt wheel 15 are visible. The polishing roll 30 is comprised of the tube 37 with the cover 34 connected to its mantle surface. The bearings 41 are received in the end areas of the tube 37 and comprise bearing pins 45 which are axially displaceable by a certain amount against the force of a spring 43. This movability toward the center of the tube 37 makes possible a simple exchange of the polishing roll 30. The ends of the bearing pins 45 facing the sidewalls 25 engage elastic components 39 which are supported in recesses or openings of the sidewalls 25 so that a floating support of the polishing roll 30 is realized. The floating support has the advantage that the drive action via the bristles 11 of the brush roll 10 is automatically adjusted. This reduces the drive action of the polishing roll 30 when the vacuum cleaning tool 1 is lifted off, i.e., the slip between brush roll 10 and polishing roll 30 is increased, while the drive action is reinforced when the vacuum cleaning tool 1 is placed on the floor. A further advantage is that the polishing roll 30 is able to adjust better to the floor conditions as a result of this bearing action.

Figure 12:
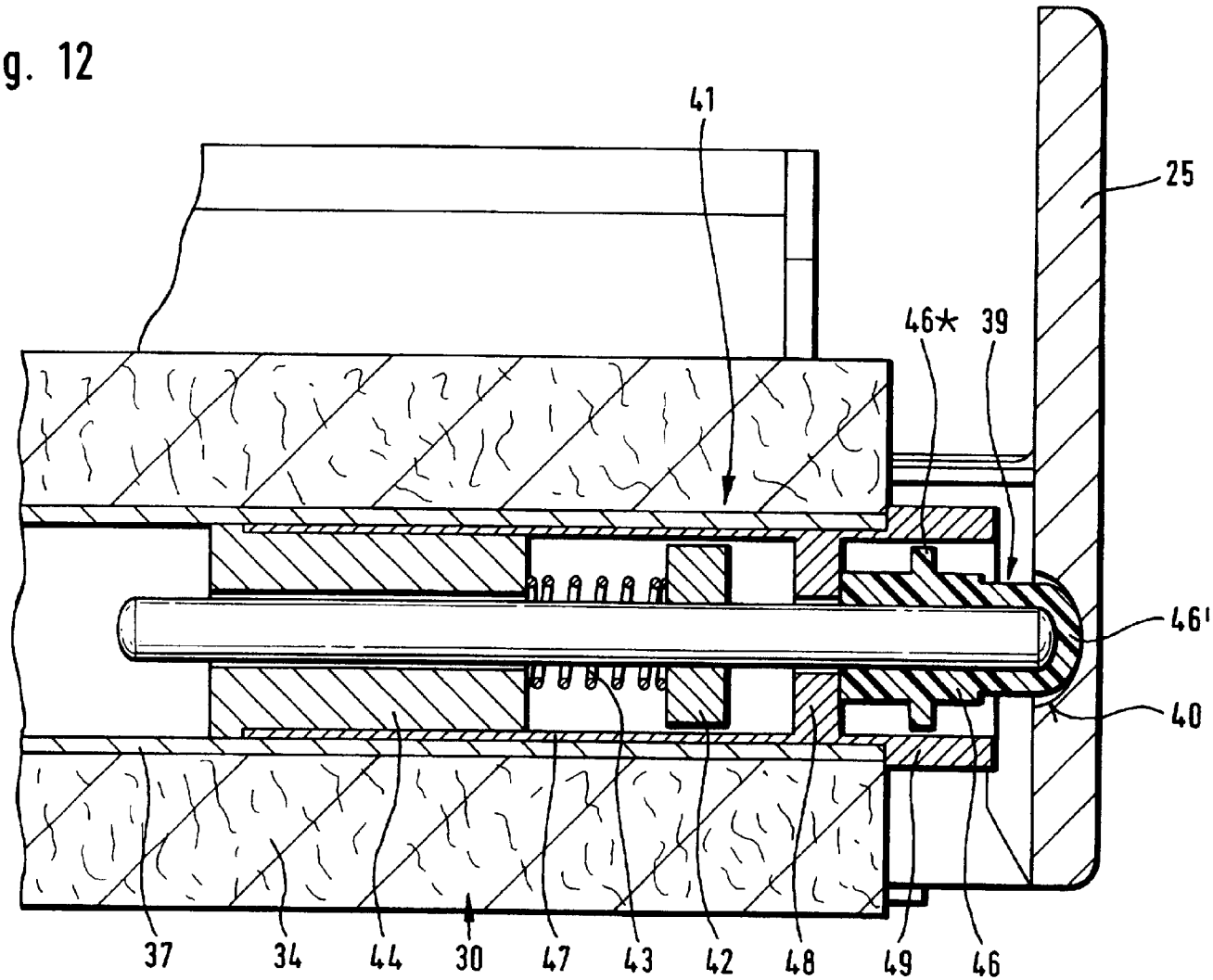
FIG. 12 is an enlarged representation of an axial section of a bearing of the polishing roll of FIG. 11.

FIG. 12 shows on an enlarged scale a section of the bearing 41 illustrated on the right side of FIG. 11. In the tube 37 of the polishing roll 30 a guide sleeve 44 for the axially movable bearing pin 45 is provided. Moreover, in the tube 37 a component is provided which comprises a spacer 47, a support ring 48 as well as a securing portion 49 engaging behind the end of the tube 37. The spacer 47 is provided to secure the position of the guide sleeve 44 relative to the end face of the polishing roll 30. A ring 42 is arranged on the bearing pin 45 and is non-positively connected thereto. Between the ring 42 and an end face of the guide sleeve 44 a spring 43 is provided which, by being supported on the ring 42, loads the bearing pin 45 in the direction toward me sidewall 25. An elastic component 39 is supported on the support ring 48. It comprises a sleeve 46 having a cap 46' of a substantially part-spherical configuration and a radial flange 46*. In this way, there is no direct contact of the bearing pin 45 on the sidewall 25; instead, the support action in any force direction is realized via the elastic component 39 so that a limited relative movement of the axis of the polishing roll 30 relative to the sidewall 25 is possible. Upon displacement of the ring 42 against the force of the spring 43, the bearing pin 45 is moved out of the cap 46' so that the end of the bearing pin 45 has a corresponding spacing to the cap 46'. As a result of the elasticity of the component 39 a deformation of the end of the sleeve 46 and of the cap 46' is possible by which the positive-locking connection between the elastic component 39 and the sidewall 25 is canceled so that the polishing roll 30 can be removed. The mounting of a new polishing roll 30 is as simple as the removal because the polishing roll can be moved between the two sidewalls 25 illustrated in FIG. 11 as a result of the elastic deformation of the component 39 until the caps 46' reach the region of the receiving opening 40 so that, as a result of the force of the spring 43, the bearing pin 45 is moved automatically into the cap 46' and secures it safely in the receiving opening 40 of the sidewall 25.

Figures 13, 14:
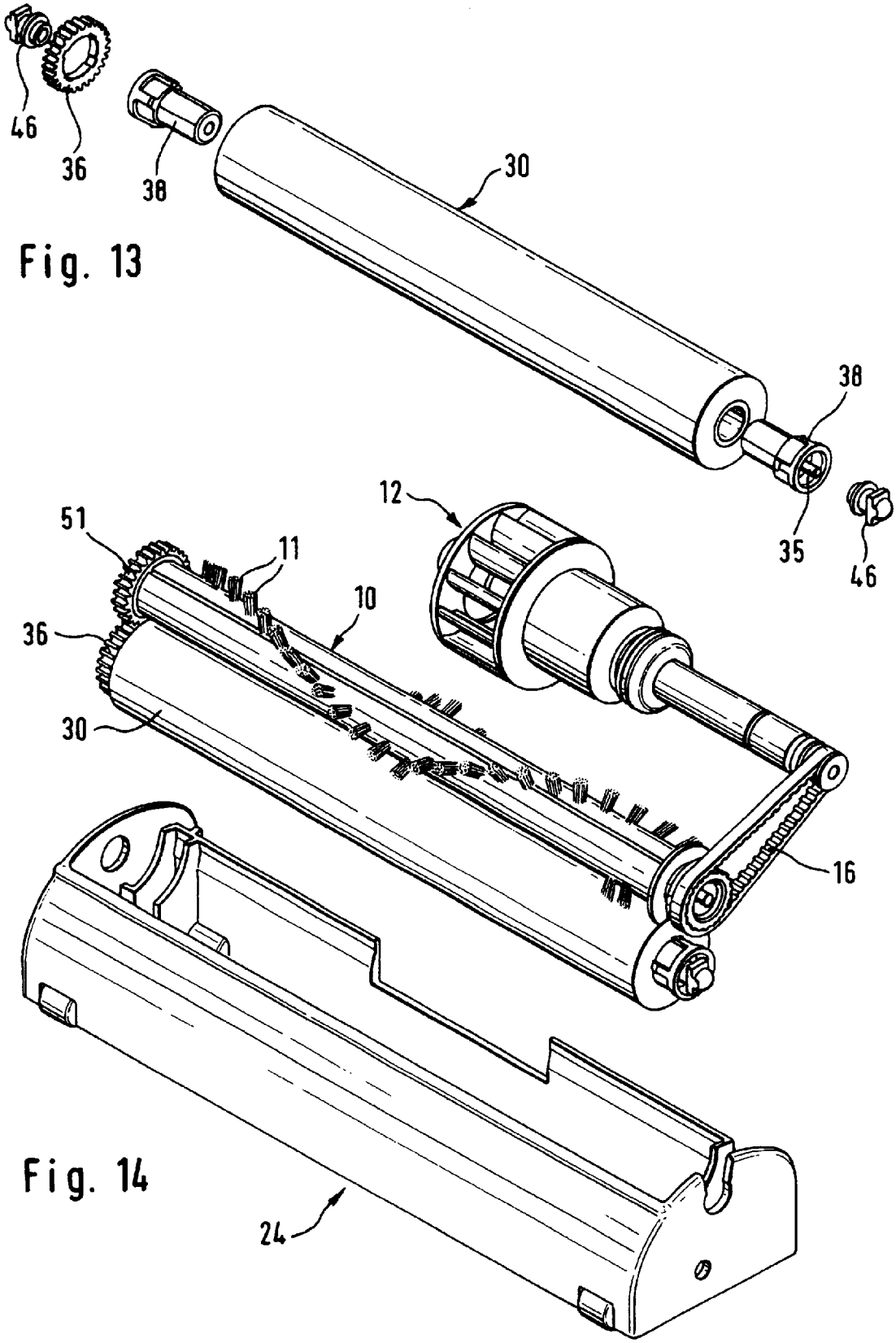
FIG. 13 is an exploded view of the polishing roll.
FIG. 14 is an illustration of the drive with gear wheels.

FIG. 13 shows an exploded view of the polishing roll 30 which is also provided with a gear wheel 36, similar to that in FIG. 7, but is provided at the end faces with bearing pins 35 and plugs 38, as shown in FIG. 9. This polishing roll 30 is driven via the gearwheel 36, as illustrated in FIG. 14, in particular, by an intermediate gearwheel 51 arranged at the end face of the brush roll 10 which then meshes with the gear wheel 36. Since the drive of the polishing roll 30 is thus realized by means of the gear wheels 36, 51, the bristles 11 of the brush roll 10 are of such a length that they do not contact the mantle surface of the polishing roll 30. For driving the complete arrangement, as described in connection with FIGS. 2 and 5, an air turbine 12 as well as a toothed belt 16 are provided. The vacuum shoe 24 corresponds to that of FIGS. 5 and 6.

While specific embodiments of the invention have been shown and described in detail to illustrate the inventive principles, it will be understood that the invention may be embodied otherwise without departing from such principles.

What is claimed is:

1. A vacuum cleaning tool for a vacuum cleaning device, said vacuum cleaning tool comprising:

a housing (2) having a vacuum connector (3) configured to be connected to the vacuum cleaning device;

a brush roll (10) arranged in said housing (2);

a drive (12) arranged in said housing (2) and drivingly coupled to said brush roll (10);

a first vacuum shoe (4) for treating a first type of floors and a second vacuum shoe (24) for treating a second type of floors, wherein the first and second vacuum shoes (4, 24) are alternatingly detachably connected to said housing (2) in accordance with the first and second types of floors to be treated, wherein said first and second vacuum shoes (4, 24) comprise an underside and an elongate intake opening (20, 23) arranged in said underside and two wall portions (17, 18; 28, 29), respectively, wherein said two wall portions (17, 18; 28, 29) am connected to said underside and extend at least approximately parallel to said brush roll (10), wherein said brush roll (10) is arranged between said two wall portions (17,18; 28, 29);

wherein said brush roll (10) extends parallel to said elongate intake opening (20, 23) of the first and second vacuum shoes (4, 24), respectively;

wherein said second vacuum shoe (24) comprises a polishing roll (30) extending parallel to said elongate intake opening (23) of said second vacuum shoe (24) and almost filling said elongate intake opening (23) of said second vacuum shoe (24), wherein said polishing roll (30) has a mantle surface projecting outwardly past a plane of said underside of said second vacuum shoe (24).

2. The vacuum cleaning tool according to claim 1, wherein said first and second vacuum shoes (4, 24) have sidewalls (5, 25) connected to opposite ends of said two wall portions (17, 18; 28, 29), respectively, so as to space said two wall portions (17, 18; 28, 29) apart.

3. The vacuum cleaning tool according to claim 2, wherein said sidewalls (5, 25) and said wall portions (17,18; 28, 29) of said vacuum shoes are formed as a monolithic part, respectively.

4. The vacuum cleaning tool according to claim 3, wherein said monolithic part is comprised of plastic material.

5. The vacuum cleaning tool according to claim 2, wherein said first and second vacuum shoes (4, 24) have openings (7, 27) and wherein said housing (2) has projections (8), wherein said openings (7, 27) and said projections (8) interact with one another to provide a mechanical connection between said first and second vacuum shoes (4, 24) and said housing (2), respectively.

6. The vacuum cleaning tool according to claim 5, wherein said openings (7, 27) are arranged in said sidewalls (5, 25) of said vacuum shoes (4, 24) and wherein said projections (8) are pins (8) projecting laterally from said housing (2) and arranged coaxially to an axis of rotation of said brush roll (10).

7. The vacuum cleaning tool according to claim 5, wherein said openings (7, 27) are bores in said sidewalls (5, 25) and wherein said sidewalls (5, 25) are elastically deformable.

8. The vacuum cleaning tool according to claim 6, wherein said openings (7, 27) have a substantially circular shape, wherein said sidewalls (5, 25) have a radially extending slot (9) connected with one end to said openings (7, 27), wherein said one end of said slots(9) has a width that is smaller than a diameter of said pins (8).

9. The vacuum cleaning tool according to claim 1, wherein said first vacuum shoe (4) has a flat configuration and wherein said brush roll (10) has bristles (11) projecting through said elongate intake opening (20) of said first vacuum shoe (4).

10. The vacuum cleaning tool according to claim 1, wherein said brush roll (10) has bristles (11) meshing with said mantle surface of said polishing roll (30).

11. The vacuum cleaning tool according to claim 1, comprising an intermediate gear (51) arranged on said brush roll (10) in said housing (2) and configured to drive said polishing roll (30), wherein said polishing roll (30) comprises a toothed gear (36) connected to an end face of said polishing roll (30) and wherein said intermediate gear interacts with said toothed gear (36).

12. The vacuum clearing tool according to claim 11, wherein said second vacuum shoe (24) has sidewalls (25) connected to opposite ends of said two wall portions (28, 29)so as to space said two wall portions (28, 29) apart and further comprising bearings (31) lockable in said sidewalls (25), wherein said polishing roll (30) is mounted in said bearings (31).

13. The vacuum cleaning tool according to claim 1, wherein said drive (12) comprises an air turbine (12) mounted in said housing (2) and configured to drive said brush roll (10) and said polishing roll (30).

14. The vacuum cleaning tool according to claim 13, wherein said drive (12) comprises a shaft (14) with a toothed gear (15) connected to said air turbine (12) and a toothed belt (16) coupling said toothed gear (15) of said shaft (14) with said brush roll (10).

15. The vacuum cleaning tool according to claim 1, wherein said drive comprises an electric motor configured to drive said brush roll (10) and said polishing roll (30).

16. The vacuum cleaning tool according to claim 15, wherein said drive comprises a shaft (14) with a toothed gear (15) connected to said electric motor and a toothed belt (16) coupling said toothed gear (15) of said shaft (14) with said brush roll (10).

17. The vacuum cleaning tool according to claim 1, wherein said polishing roll (30) is comprised of a core (32, 37) and a cover (34) of a textile material covering said core (32, 37), wherein said core (32, 37) has end faces with bearing pins (35, 45).

18. The vacuum cleaning tool according to claim 17, wherein said cover (34) is a uniform cover layer extending across the entire axial length of said core (32, 37) and connected to said core (32, 37) only in the vicinity of said end faces.

19. The vacuum cleaning tool according to claim 17, wherein said cover (34) is divided into portions having different radial height, said portions arranged sequentially in an axial direction of said cover (34).

20. The vacuum cleaning tool according to claim 19, wherein said portions comprise first portions and second portions, wherein said first portions have an axial length of approximately 3 mm and said second portions have an axial length of approximately 10 mm, wherein said first portions are taller and softer than said second portions.

21. The vacuum cleaning tool according to claim 17, wherein said cover (34) is divided into portions of different degrees of hardness arranged sequentially in an axial direction of said cover (34).

22. The vacuum cleaning tool according to claim 21, wherein said portions comprise first portions and second portions, wherein said first portions have an axial length of approximately 3 mm and said second portions have an axial length of approximately 10 mm, wherein said first portions are taller and softer than said second portions.

23. The vacuum cleaning tool according to claim 17, wherein said cover (34) is attached to said core (32, 37) by a glue or a weld.

24. The vacuum cleaning tool according to claim 17, wherein said second vacuum shoe (24) has sidewalls (25) connected to opposite ends of said two wall portions (28, 29) 50 as to space said two wall portions (28, 29) apart and wherein said sidewalls (25) have receiving openings (40) and wherein said bearing pins (45) comprise a spring (43) and are configured to be moved by said spring (43) automatically into said receiving openings (40) of said sidewall (25), wherein said bearing pins (45) have ends facing said sidewalls (25) and said ends have a sleeve (46) comprised of an elastic material, and wherein said sleeve (46) has a part-spherical cap (46'received in said receiving openings (40), respectively.

* * * * *